US010219330B2

(12) United States Patent
Pereira

(10) Patent No.: US 10,219,330 B2
(45) Date of Patent: Feb. 26, 2019

(54) ELECTRONIC OVEN WITH SPLATTER PREVENTION

(71) Applicant: The Markov Corporation, Dover, DE (US)

(72) Inventor: Arvind Antonio de Menezes Pereira, Milpitas, CA (US)

(73) Assignee: The Markov Corporation, Dover, DE (US)

( * ) Notice: Subject to any disclaimer, the term of this patent is extended or adjusted under 35 U.S.C. 154(b) by 0 days.

(21) Appl. No.: 15/851,490

(22) Filed: Dec. 21, 2017

(65) Prior Publication Data

US 2018/0192483 A1 Jul. 5, 2018

Related U.S. Application Data

(60) Provisional application No. 62/442,300, filed on Jan. 4, 2017.

(51) Int. Cl.
*H05B 6/64* (2006.01)
*H05B 6/68* (2006.01)

(52) U.S. Cl.
CPC ..... *H05B 6/6447* (2013.01); *H05B 6/6455* (2013.01)

(58) Field of Classification Search
CPC ..... H05B 6/68; H05B 6/668; H05B 6/6455
USPC ..... 219/716, 705, 709, 710, 711, 712, 713, 219/714, 720, 707, 494, 510; 374/149, 374/121, 126, 129, 130, 131, 133; 99/325
See application file for complete search history.

(56) References Cited

U.S. PATENT DOCUMENTS 5,283,410 A 2/1994 Kim
5,293,019 A 3/1994 Lee
5,360,966 A 11/1994 Noda
5,378,875 A 1/1995 Hirama
(Continued)

FOREIGN PATENT DOCUMENTS

CN 205026746 U 2/2016
EP 1335635 A3 10/2005
(Continued)

OTHER PUBLICATIONS

PCT International Search Report_PCT/US2017/068199_dated Apr. 3, 2018.

*Primary Examiner* — Quang T Van
(74) *Attorney, Agent, or Firm* — Daylight Law, P.C.

(57) ABSTRACT

This disclosure includes an electronic oven and an accompanying control system that avoid boiling or splattering in a heating chamber of the oven while an item is being heated in the chamber. A disclosed method which can be executed by the control system includes evaluating sensor data from a visible light sensor and sensor data from an infrared light sensor. The controller is communicatively coupled to the visible light sensor and the infrared light sensor. The method is directed towards generating a splatter prediction in response to the evaluation of the sensor data from the visible light sensor and the sensor data from the infrared light sensor. The method is further directed towards decreasing a power level of the microwave energy source in response to the splatter prediction. The controller is also communicatively coupled to the microwave energy source.

20 Claims, 6 Drawing Sheets

(56) References Cited

U.S. PATENT DOCUMENTS

| | | | | |
|---|---|---|---|---|
| 6,229,130 | B1 * | 5/2001 | Furuta | H05B 6/6455 219/494 |
| 6,875,968 | B2 | 4/2005 | Lee | |
| 2013/0306627 | A1 * | 11/2013 | Libman | H05B 6/6435 219/705 |
| 2014/0203012 | A1 | 7/2014 | Corona | |
| 2015/0289324 | A1 * | 10/2015 | Rober | H05B 6/68 219/711 |

FOREIGN PATENT DOCUMENTS

| | | | |
|---|---|---|---|
| JP | S63286623 | A | 11/1988 |
| JP | 2003090540 | A | 3/2003 |
| JP | 2008286466 | A | 11/2008 |
| JP | 2015053206 | A | 3/2015 |
| KR | 20040097856 | A | 11/2004 |

* cited by examiner

100

300

ELECTRONIC OVEN WITH SPLATTER PREVENTION

CROSS REFERENCE TO RELATED APPLICATIONS

This application claims the benefit of U.S. Provisional Application No. 62/442,300, filed Jan. 4, 2017, which is incorporated by reference herein in its entirety for all purposes.

BACKGROUND OF THE INVENTION

Electronic ovens heat items within a chamber by bombarding them with electromagnetic radiation. In the case of microwave ovens, the radiation most often takes the form of microwaves at a frequency of either 2.45 GHz or 915 MHz. Electronic ovens tend to heat food unevenly and in a less predictable manner as compared to traditional methods. As a result, a common issue faced by the operators of electronic ovens is the uncontrolled boiling, splattering, or spilling of items in the electronic oven. For example, water heated in an electronic oven can experience a condition known as flash boiling in which it can transition from a still state to a vigorous boil in what appears to be a near instantaneous transition. It can be difficult for an operator to be able to detect this condition and shut off power to the microwave to prevent the ensuing mess. More generally, any food item with a sauce or liquid component can undergo splattering as the surface of the item experiences the highest level of heat from the electromagnetic bombardment.

The problem of splattering or boiling in an electronic oven has generally been addressed via the provisioning of monitoring capabilities to human operators. In one approach, the electronic oven is equipped with a window, or some other mechanism, to allow an operator to visibly monitor the item being heated and adjust the heating process to avoid or mitigate a boil or splatter condition. However, this approach requires the constant attention of a human monitor to detect a spill condition and act to mitigate its effects. Boiling conditions have been detected using other sensors such as humidity sensors that are used to maintain an item in a boiling state. However, these approaches are directed to detecting the occurrence of a boiling state, not the prevention of a boiling state (i.e., they detect when boiling has already started rather than when boiling is about to happen).

SUMMARY

An electronic oven and an accompanying control system are disclosed herein that avoid boiling or splattering in a heating chamber of the oven while an item is being heated in the chamber. Some of the control systems disclosed herein analyze the input to the control system to predict the occurrence of boiling or splattering in the heating chamber and provide control system outputs that prevent or mitigate the boiling or splattering before it occurs. The control system inputs can include sensor inputs from various sensors on the electronic oven that obtain sensor data to determine the state of the item in the chamber. The control system outputs can include a command to an energy source to decrease the amount of electronic energy supplied to the chamber. As used herein, all of the states that an item in an electronic oven can be in that exhibit a likelihood of spilling in a proximate time period, such as via boiling, splattering, or overflowing, can be referred to as imminent splatter states. A proximate time period is on the order of 1-2 seconds from the current time. Similarly, the state an item is in when it is actually spilling in the oven can be referred to as a splatter state. The occurrence resulting from the entry of the item into the splatter state can be referred to as a splatter event.

Some of the control systems that are disclosed herein can detect when an item is in an imminent splatter state and take an intervening action to prevent the actual splatter state from occurring. In specific approaches, the imminent splatter state is separated from the actual splatter state by roughly 1-2 seconds of time along the present course of action without intervention by the control system. Certain approaches involve intervening actions in the form of a reduced amount of power supplied to the chamber or the movement of the item within the chamber relative to a pattern of heat distribution in the chamber as provided by the electronic oven. The latter approach can involve moving the entire item to a portion of the pattern with lower energy, or by rearranging the item so that a hotter portion of the item is moved to a portion of the pattern with lower energy.

The sensors utilized to obtain sensor data for the control system can take on various forms. The sensors could include temperature sensors, auditory sensors, RF parameter sensors, humidity sensors, particulate concentration sensors, altitude sensors, a weight sensor such as a scale, and any other sensors known in the art. The sensor data can be used to identify an item as belonging to a specific class of items that are known to the control system. For example, weight and visible light data could be used to identify an item as a 0.5 pound chicken breast. The sensor data can also be used to identify the location of the item in the chamber. The sensor data can also be used to detect an imminent splatter state such as via application of the sensor data to a classifier such as a neural network or support vector machine. Furthermore, the sensor data can be combined in various ways as described below to assist the detection of an imminent splatter state based on the identity of the item.

In one approach, an electronic oven comprises a chamber, a microwave energy source coupled to an injection port in the chamber, a visible light sensor, an infrared light sensor, and a controller communicatively coupled to the visible light sensor, the infrared light sensor, and the microwave energy source. The electronic oven also comprises a non-transitory computer-readable medium on the controller. The computer-readable medium stores instructions to: evaluate sensor data from the visible light sensor and sensor data from the infrared light sensor, generate a splatter prediction in response to the evaluation of the sensor data from the visible light sensor and the sensor data from the infrared light sensor, and decrease a power level of the microwave energy source in response to the splatter prediction.

In another approach, a method is used for heating an item in a chamber of an electronic oven using a microwave energy source. Each step in the method is executed by a controller in the electronic oven. The method comprises evaluating sensor data from a visible light sensor and sensor data from an infrared light sensor. The controller is communicatively coupled to the visible light sensor and the infrared light sensor. The method also comprises generating a splatter prediction in response to the evaluation of the sensor data from the visible light sensor and the sensor data from the infrared light sensor. The method also comprises decreasing a power level of the microwave energy source in response to the splatter prediction. The controller is also communicatively coupled to the microwave energy source.

DETAILED DESCRIPTION OF THE EMBODIMENTS

Reference now will be made in detail to embodiments of the disclosed invention, one or more examples of which are illustrated in the accompanying drawings. Each example is provided by way of explanation of the present technology, not as a limitation of the present technology. In fact, it will be apparent to those skilled in the art that modifications and variations can be made in the present technology without departing from the scope thereof. For instance, features illustrated or described as part of one embodiment may be used with another embodiment to yield a still further embodiment. Thus, it is intended that the present subject matter covers all such modifications and variations within the scope of the appended claims and their equivalents.

Figure 1:
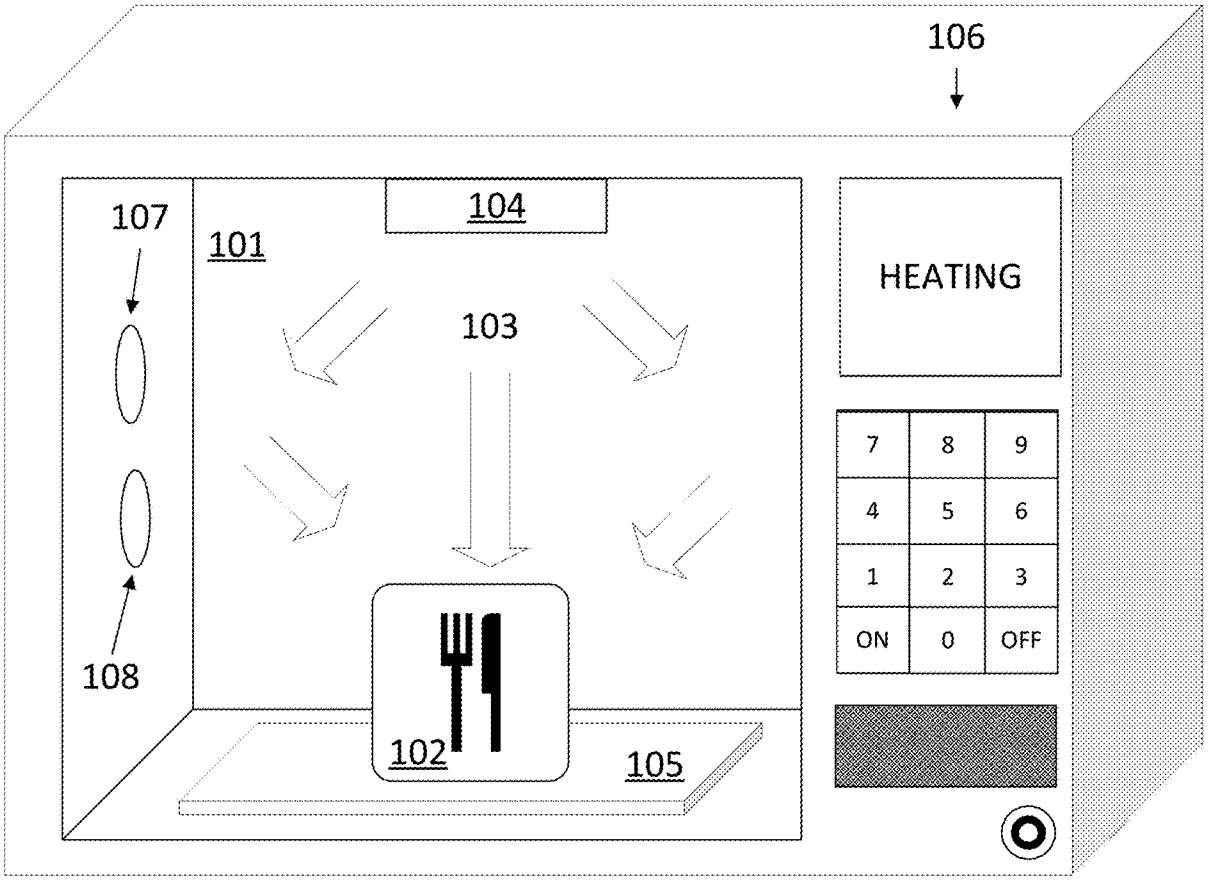
FIG. 1 illustrates an electronic oven having various features that are in accordance with embodiments disclosed herein.

FIG. 1 illustrates features of an example electronic oven 100. The oven opening is not illustrated in order to reveal chamber 101 in which item 102 is placed to be heated. Item 102 is bombarded by electromagnetic waves 103 via an energy source 104. The item can be placed on a tray 105. Electronic oven 100 also includes a control panel 106 to receive commands from an operator and provide information back to the operator. The control panel 106 is communicatively coupled to a controller located within oven 100 but outside chamber 101. The controller can include a processor, ASIC, or other embedded system core, and can be located on a printed circuit board or other substrate. The controller can also have access to a nonvolatile memory such as flash to store instructions for executing the methods described herein. The controller can serve as the core information processing system for the control systems disclosed herein. The controller can also be split between a cloud-based processor and a local client processor that act in combination to execute the methods described herein. The local client processor can include a wireless communication module.

Energy source 104 can be a source of electromagnetic energy. The source could include a single wave guide coupled to an injection port or antenna. The source could include an array of antennas. The electromagnetic waves 103 can be microwaves. The electronic oven 100 can include a cavity magnetron that produces microwaves from direct current power. The magnetron could be coupled to the injection port or antenna via a waveguide. The microwaves could have a frequency of 2.45 GHz or 915 MHz. The cavity magnetron can be powered by modern inverter microwave technology such that microwaves can be produced at varying power levels. However, traditional power conditioning technology can be used to produce a set level of direct current power for the magnetron. The electromagnetic waves 103 could be radio frequency waves generally. The frequency of the waves could also be alterable by energy source 104. Energy source 104 could also be configured to produce multiple wave patterns with different frequencies simultaneously.

Electronic oven 100 could also include one or more connections to a wired or wireless communication system. For example, the oven could include a radio for a satellite or Wi-Fi connection. The controller for electronic oven 100 could include a web browser or simple HTTP client for communicating over the Internet via that radio. The wireless communication system and controller could also be configured to communicate over a LAN or PAN such as through the use of Bluetooth, Zigbee, Z-wave or a similar standard. The radio could also be configured to conduct inductive communication with RFID tags placed on the packaging of items to be heated. The inductive communication could be NFC communication.

The electronic oven could communicate via any of the aforementioned means to a central server administrated by or on behalf of the manufacturer of electronic oven 100 to receive updates and provide information on the machine's operation. All of the functionality provided by control panel 106 can be provided by a separate consumer device such as a mobile telephone or web portal on a workstation via any of the aforementioned means. Communication could include providing status information from the oven to the device or commands from the device to the oven. Additional functionality may be provided given the potential for the device and oven to be in separate places (e.g., more frequency status updates or a visible light image of what is in the chamber).

Electronic oven 100 can also include a discontinuity in the walls of chamber 101 that is configured to allow electromagnetic radiation to channel out of the chamber. The discontinuity could be an opening 107. Although the opening 107 in the electronic oven is shown on a wall of chamber 101, the opening can be located anywhere on the surface of chamber 101 which provides a sufficient view of the interior of chamber 101. The opening could comprise a past cutoff waveguide with physical parameters set to block the electromagnetic energy from energy source 104 while allowing electromagnetic energy in other spectrums to escape through opening 107. For example, microwave energy could be prevented from exiting the opening while visible light and infrared energy were allowed to pass through opening 107.

A sensor or set of sensors could be configured to receive energy from opening 107 either directly or through a waveguide. The sensor or set of sensors could be configured to detect infrared light, visible light, or a combination of the two. The sensor could be configured to sense a surface temperature distribution of item 102 and a visible light image of item 102. The sensor or set of sensors could include an IR camera, a visible light camera, a thermopile, or any other sensor capable of obtaining visible light sensor data and/or infrared light sensor data. In a specific example, the opening could be connected to a standard visible light camera with an IR filter removed in order for the camera to act as both a visible light sensor and an infrared sensor and receive both infrared sensor data and visible light sensor data.

The same opening could be used by more than one sensor. In one approach, a time multiplexed filtering system, which could be used additionally or in the alternative to the past cutoff waveguide, could allow a single sensor to detect both visible light and infrared energy from the same stream of electromagnetic energy. The filter could comprise a wheel, or other selector, with filters for different spectra of electromagnetic energy. The wheel would be placed in line with the stream of electromagnetic energy and alternatively transmit solely the visible light or infrared energy. A sensor, or sensors, placed on the alternative side of the wheel would then be able to detect the desired light from the incoming stream. In another approach, the sensors could be configured to continuously obtain different segments of the same stream of electromagnetic energy by, for example, being positioned at slightly different angles with respect to opening 107.

An example electronic oven can also include additional openings, such as opening 108, in order to obtain different views of item 102. However, a camera applied to sense visible light through opening 107 could alternatively be a three dimensional camera to achieve a similar result. In particular, two openings can be utilized with two cameras to obtain stereoscopic information regarding item 102. As another particular example, the two openings could be used to obtain different streams of data (e.g., opening 107 could obtain a stream of visible light sensor data while opening 108 obtained a stream of infrared light sensor data).

The controller can be communicatively coupled to the sensors, such as the infrared light sensor and/or the visible light sensor, and the energy source. In effect, the controller can close a feedback loop comprising an evaluation of the control system's input in the form of sensor data and produce outputs in the form of commands to the microwave energy source. The commands to the energy source can involve an adjustment of the energy being applied to the chamber in terms of both magnitude and spatial distribution in the chamber. For example, if the electronic oven included an inverter to modulate an amount of energy emitted by a microwave energy source from a first level to a second level, the controller could issue a command to make such an adjustment in response to an evaluation of the sensor data. The control system can also be communicatively coupled to additional elements of the microwave oven to effectuate an alteration to the relative spatial distribution in the chamber between item 102 and a pattern of nodes and antinodes created by electromagnetic waves 103. Such elements include moving parts that can rotate or translate the position of tray 105.

A controller in an electronic oven can be configured to evaluate sensor data from a visible light sensor and sensor data from an infrared light sensor, generate a splatter prediction in response to that evaluation, and take an action to prevent the splatter state from being realized. A splatter prediction is information representative of the control system's belief that an item in the chamber is in an imminent splatter state. The prediction can be a Boolean value or it can be a numeric value representing a probability (e.g., a value of 0.9 represents a high probability while a value of 0.1 represents a low probability). To this end, the controller can utilize the sensor data to detect that an item in the electronic oven is in an imminent splatter state and produce a control output to prevent the item from entering the splatter state.

Figure 2:
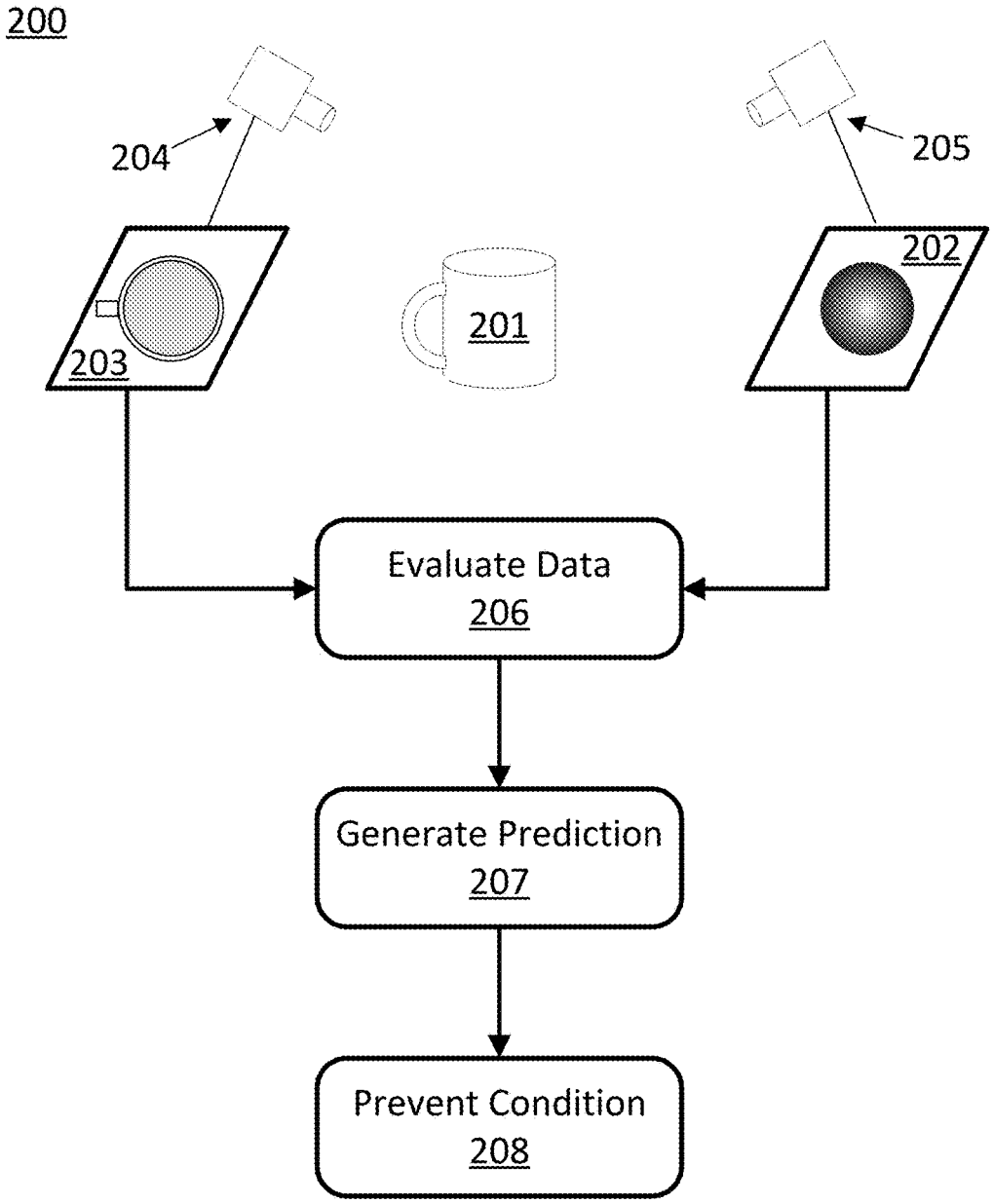
FIG. 2 illustrates a flow chart of a set of methods for preventing splatter in an electronic oven that can be conducted by a controller in the electronic oven in accordance with embodiments disclosed herein.

FIG. 2 includes a flow chart 200 of a set of methods that can be conducted by a controller in an electronic oven to detect an imminent splatter state and prevent a splatter state from occurring. Item 201 in FIG. 2 is a cup of coffee being heated in an electronic oven. In step 206, the controller evaluates visible light sensor data 203 from a visible light sensor 204 and infrared light sensor data 202 from an infrared light sensor 205. As mentioned previously, the two sensors could be implemented using a single hardware element but with different software processing. In step 207, the controller generates a prediction as to the likelihood that item 201 is in an imminent splatter state in response to the evaluation in step 206. In step 208, the controller conducts an action to prevent item 201 from actually reaching the splatter state in response to the prediction. For example, step 208 could involve the controller decreasing a power level of the energy source or moving the relative position of the item with respect to a pattern of nodes and antinodes in the chamber caused by the source of microwave energy.

A controller in accordance with this disclosure can evaluate the received sensor data in various ways. In a general approach, raw sensor data from all of the sensors in the electronic oven could be evaluated by a single powerful classifier such as a deep learning neural network. However, in other approaches, the evaluation will include a certain degree of segmentation and preprocessing before the data is applied to a classifier or other machine intelligence system. Given the large number of potential items that can be placed in an electronic oven and the enormous variation of their response to electromagnetic bombardment, it has been found that approaches in which at least some degree of preprocessing is conducted are more easily implemented from an algorithm training perspective. As such, the evaluation of sensor data can include using the sensor data to segment the item within the chamber, initialize a classifier that will be used to generate the prediction value, or conduct some other form of preprocessing such as facilitating feature detection. Evaluation of the data can also include preprocessing the data with any number of feature detectors prior to feeding the data to a classifier. Evaluation of the data can also involve preprocessing the data by combining it in various ways for utilization by a classifier or other machine intelligence system that will generate a prediction. The preprocessed sensor data can then be evaluated by the classifier.

Returning to the example of FIG. 2, the sensor data obtained from the infrared light sensor 205 and the visible light sensor 204 could both be used in step 206 to identify an item and initialize a classifier that has been trained specifically to generate a splatter prediction value for items with the same identity. The identity of the item can be a species or genus identity (e.g., the sensors could detect a cup of coffee and initialize the thin-homogenous-liquids classifier or the cup-of-coffee classifier). Evaluation of the sensor data, such as in step 206, could then also include evaluating sensor data using the initialized classifier to determine if the item was in an imminent splatter state. The output of the classifier could be a numerical value indicating the probability that the item is in an imminent splatter state. This value could be compared against a threshold in step 207 to generate a Boolean splatter prediction. The threshold could be a set number or it could be initialized based on the identity of the item. Sensor data, such as altitude data derived from a cloud connection or actually determined from a physical altitude sensor, could also be used to initialize the classifier or the threshold (e.g., a high altitude would decrease the threshold since items are more likely to boil at high altitude). Different subsets of the sensor data can be applied to the identifying step, the classifier initialization step, and the evaluation step. For example, the identifying could be accomplished using the visible light sensor data alone, the infrared light sensor data alone, or both sets of sensor data in combination.

Figure 3:
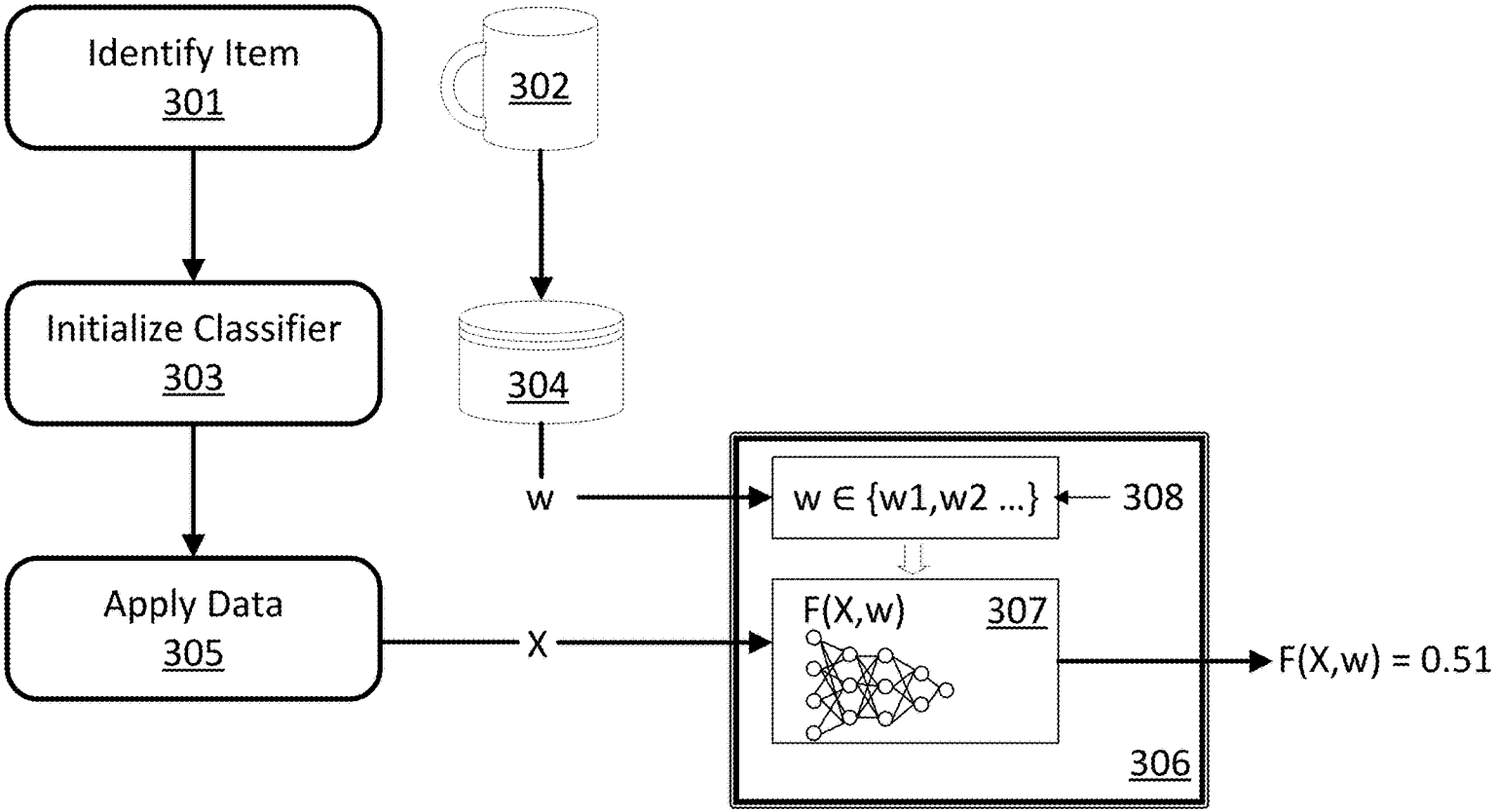
FIG. 3 illustrates a flow chart of a set of methods for initializing a classifier to prevent splatter in an electronic oven that can be conducted by a controller in the electronic oven in accordance with embodiments disclosed herein.

FIG. 3 includes a flow chart 300 of a set of methods that can be conducted by a controller in an electronic oven. Specifically, the set of methods in flow chart 300 can be used to execute steps 206 and 207 in FIG. 2. In step 301, an item in the chamber is identified using visible light sensor data. This step can be conducted by applying the visible light sensor data to an image recognition routine. In the illustrated case, item 302 is identified as a cup of coffee in step 301. Step 301 can be conducted before the energy source is powered on. However, it can also be conducted after energy has been applied to the item so that the item's response to heat can be evaluated to assist in identifying the item. As such, step 301 can also involve an evaluation of the infrared sensor data produced by the item.

In step 303, a classifier is initialized using the identity of item 302 as obtained in step 301. As illustrated, the identity is used as a key to obtain a set of weights "w" for a neural network classifier from a data store 304. Data store 304 can include a large number of values for "w" that represent the result of multiple neural networks training on the detection of an imminent splatter state for numerous different items. As mentioned previously, initialization of the classifier can be conducted based on different genera or species of items. For example, there may be a set of stored weights specifically for a cup of coffee or there may be a set of weights for homogenous non-viscous liquids. The data store can also store multiple potential matches for a given item and provide a best-fit set of weights if the identity of the item cannot be determined with particularity. The data store can also include a set of default weights, or other data needed to initialize the classifier, that is generally applicable when the identity of the item is not discernable.

Step 303 could also involve initializing a composite classifier based on the detection of multiple sub-items in the chamber. As the chamber may house sub-items with portions having widely varying responses to heat and likelihoods of splattering, it may be necessary to combine classifiers trained for each of those sub-items into a single unit when executing step 303 in order to limit the amount of training needed for the classifiers while still maintaining a large degree of customized coverage for splatter detection in the oven. For example, separate classifiers may need to be stored in data store 304 and be initialized in combination. In this way, the data store would not need to store a lasagna and rice classifier but would instead just need to store a lasagna classifier and a rice classifier, and combine the two when those sub-items were detected in combination. The exact manner in which the classifiers were combined could be conducted according to a predetermined approach and be based on the location of the items in the electronic oven and their relative sizes. The threshold for the execution of step 207 described above could likewise be individually configurable for each of the sub-items.

In step 305 sensor data "X", possibly after undergoing a given degree of preprocessing, is applied to classifier 306. In this case, the classifier includes a neural network 307 that has been initialized by weights 308. The output from the classifier can take on many forms. In the illustrated example, the output is in the form of a probability that the item is in an imminent splatter state in a range of zero to one. In this case, the output is 0.51 which indicates that it is more likely than not that the item is in an imminent splatter state. In response, the controller may choose to reduce power to the chamber to avoid a potential spill. In the case of a classifier detecting the condition of multiple sub-items, different values could be output for each of the sub-items separately. Furthermore, as will be described below, the output could include additional information that could be used by the controller to adjust the electronic oven in a specific way to prevent the item from splattering.

The data applied to the classifier in step 305 could be any sensor data obtained by the electronic oven. For example, the sensor data could be the infrared sensor data alone or a combination of infrared and visible light sensor data. Certain benefits accrue to approaches in which both sets of data are utilized because sometimes an imminent splatter state cannot be detected accurately using one set of information or the other. For example, if visible data alone is utilized, the classifier might not be able to prevent flash boiling because there is very little visible sign that the item is about to boil before an actual spill occurs. As another example, if thermal data alone is utilized, a concentrated area of heat around the border of a container might be taken to indicate an imminent splatter state because the classifier might not have the intelligence required to determine that the concentrated area of heat is due to an interface condition and is not actually indicative of an imminent splatter.

Figure 4:
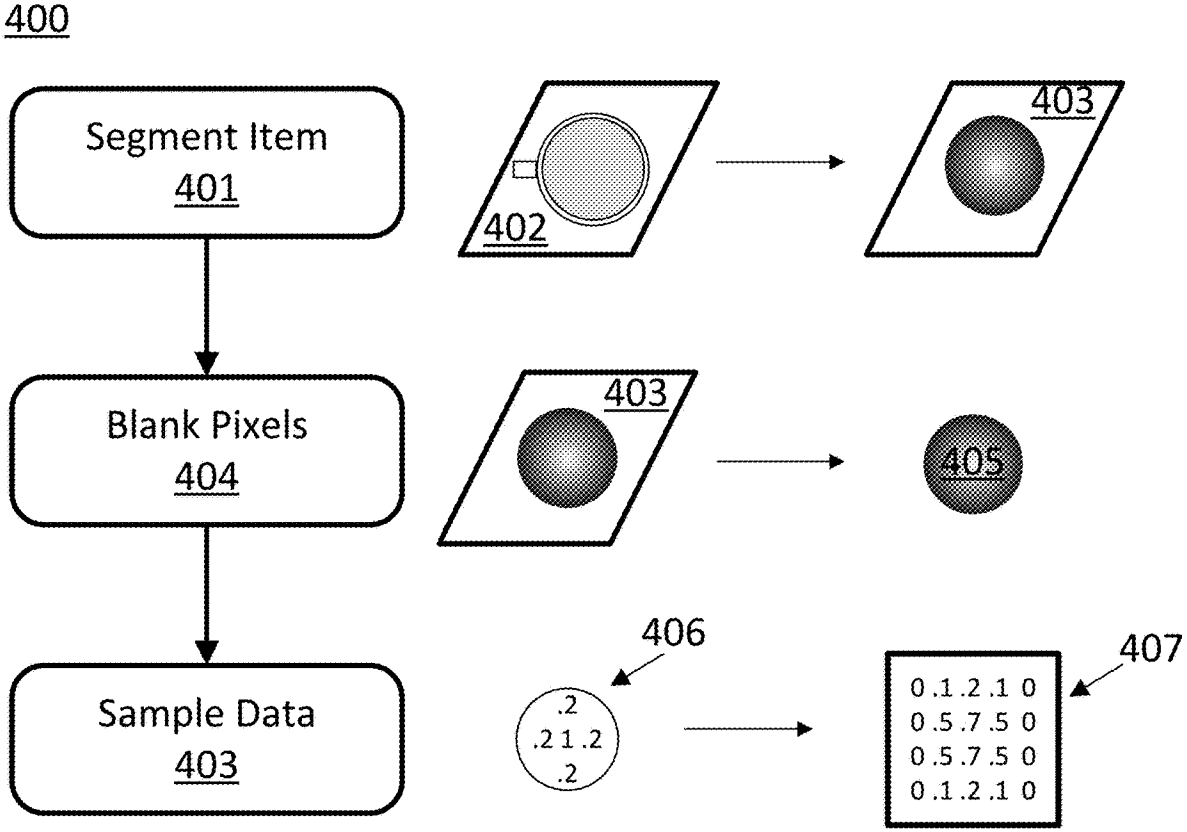
FIG. 4 illustrates a flow chat of a set of methods for preprocessing data for a classifier to prevent splatter in an electronic oven can be conducted by a controller in the electronic oven in accordance with embodiments disclosed herein.

The sensor data from the visible light sensor and the infrared light sensor can undergo various preprocessing steps before it is applied to a classifier. A specific example of this preprocessing can be described with reference to FIG. 4. Flow chart 400 illustrates a set of methods for preprocessing sensor data to make it more amenable to the performance and training of a classifier such as a neural network. The specific approach is illustrated to highlight certain potential combinations of preprocessing that can be utilized in accordance with this disclosure, and should not be interpreted as a limiting feature of this disclosure.

In step 401, the item is segmented using at least the sensor data from the infrared light sensor. The use of the infrared light sensor data is beneficial here because the interior chambers of microwaves are designed to not absorb electromagnetic energy at the frequency of their energy sources and thereby release infrared radiation. Furthermore, food containers designed for use with electronic ovens generally do not absorb electromagnetic energy and radiate infrared light. As a result, an infrared signature of the chamber after receiving a burst of heat is a good proxy for being able to segment the food item out from the rest of the chamber. This is illustrated by the liquid in item 402 being shaded gray while the container in which it is located does not show up in the infrared signature 403.

The approaches of flow chart 400 continue with step 404 in which a set of pixels in the sensor data is blanked based on the segmenting of the item in the chamber from step 401. In the illustrated example, all of the pixels except for those that responded to a pulse of heat are set to a zero value or are deleted from the sensor data to produce a subset of sensor data 405. The segmentation can involve multiple sub-items in the chamber that may or may not be contiguous after the segmenting step has taken place. In some approaches, the sub-items, and their associated sensor data, are then treated separately by all downstream portions of the controller's processing.

The approaches of flow chart 400 continue with step 403 in which the remaining sensor data is sampled to produce an input for the classifier. This input can then be applied to a classifier. For example, the sensor data can be sampled to create a matrix of values having a certain number of rows and columns to make the matrix compatible with the classifier. This step can also involve sampling the remaining sensor data using subsampling with bilinear interpolation. As illustrated, the subset of sensor data 405, which is illustrated with numerical values in the representation of that sensor data 406, can be sampled to obtain 16 values in a matrix 407 to be used to train the classifier or to obtain a prediction from a trained classifier.

The approaches illustrated by flow chart 400 exhibit beneficial features in terms of increasing the efficiency of both the training of the classifier and the real time performance of the classifier. Removing the material that does not respond to heat, and is not going to splatter, assures that the data used to train and trigger the classifier is feature rich and can be trained efficiently. Furthermore, any information lost as to the actual surface area sampled can be saved while conducting step 404 and injected back into the classifier as a single value indicating the surface area of the item or sub-item. In addition, it has been found that the detection of an imminent splatter state correlates much more strongly with the identity of the item and sensor data obtained from specific points on the item as opposed to information concerning the total surface area of the item. This finding is particularly applicable to the use of microwaves for purposes of heating food items as the items tend to not vary in size by more than an order of magnitude.

Preprocessing of the sensor data can also involve applying the sensor data to a feature detector or a set of feature detectors. The features could be detected by the feature detector and stored as a feature vector. For example, the feature detector could be used to monitor a speed at which the circumference of an item is changing. Such an approach can be utilized for heating liquid because rapid changes of the circumference of the liquid indicates the presence of bubbles and other disturbances on the surface of the liquid. The feature detectors could also be used to monitor for rapid changes in color in visible light sensor data owing to the formation and destruction of bubbles on the surface of the item. The feature detectors could also be used to monitor for rapid movement anywhere on the item which would provide evidence of disturbances and an impending splatter. These feature detectors may produce feature vectors that can be applied to the sensor data before it is provided to the classifier. The feature vectors can also be appended to other data sets, such as a matrix of raw sensor data, before being applied to the classifier.

Preprocessing of the sensor data can also involve cancelling out movement of the item in the chamber owing to the operation of the control system. In situations where the control system moves the item in the chamber in order to more evenly heat the item, data regarding this movement could be applied to cancel out that translation in the sensor data. This approach would be particularly useful to situations in which feature detectors, or the intelligence of the classifier itself, was utilizing the rapid movement of parts of the item as evidence of an imminent splatter condition. This is because movement of the item owing to a movable tray or other device, which tends to reduce the probability of localized build-up of heat and a splatter condition, can be isolated from movement of the item owing to localized thermal disturbances.

Preprocessing of the sensor data can also involve obtaining a chronological delta of any of the units of sensor data. This type of preprocessing can generally be applied to any of the data forms mentioned above as it tracks the change in a data point across time. To the extent the data point exists, and varies with time, this will generally provide useful information for detecting an impending condition. In its most basic form, the delta can be a current set of raw data points subtracted from a set of raw data points obtained in the near past. For example, the data could be representative of a change in the thermal state of an item across a moving window of two or more thermal images. Such an approach provides information regarding the rate of change of the item in the chamber. As another example, changes in the visible light sensor data, and variations thereof, can be used to capture information regarding spatial variations in the item such as the presence of bubbles.

The various features and sampled data described above can be combined into a single unit of data to be applied to the classifier. For example, a heat map of pixel values "h(n)" representative of the current thermal state of the surface of an item could be appended to a rate of change of the heat map "delta(n)" to produce a single matrix to be applied to the classifier. In another example, the heat map of pixel values could be combined with a single value representative of the absolute temperature of the item, or an average temperature in the chamber. Different classifiers could be designed to accept different combinations of all the sensor data that can be obtained and processed variations thereof. In approaches in which the classifier is selected based on an identity of the item, the exact method of preprocessing and feature detection could be selected based on an identity of the item as well. Indeed, such an approach would be necessary where the selected classifiers varied in terms of their required inputs.

Information besides sensor data could also be applied to the classifier to detect an imminent splatter state. In particular, data regarding the current control outputs of the controller could be combined with the sensor data and provided to the classifier. This form of data can be referred to as controller data. For example, the amount of energy being applied to the chamber could be included in the data provided to the classifier. This form of data could be useful because the same infrared signature may indicate an item that will splatter in the near future if the electronic oven is providing a high amount of energy to the chamber while it would not splatter in the near future if the electronic oven is providing a lower amount of energy to the chamber.

Certain combinations of features and sensor data are particularly useful for specific applications. In particular, the use of feature detectors that identify movement of particles and feature detectors that provide an indication of how the heat is being absorbed and spread through the item are useful for detecting splatter because they can be used by the classifier to intuit the density of an item. These forms of feature detectors can be referred to as particle movement feature detectors and heat diffusion feature detectors. Understanding the density of the item via processing by the classifier has been determined to be of particular utility for preventing splatter. Dense materials like thick soups can at times vigorously splatter via the ejection of a small but very hot mass of liquid. The splatter can originate from any part of the liquid surface—even when the surface of the liquid appears relatively uniform and calm compared to water that is on the verge of splattering. In contrast, less viscous liquids with faster mixing are less prone to the surprising eruption of liquid in the same way. As a result, feature detectors or classifier intelligence need to be able to approximate both types of conditions—gradual but reliable and the sudden rare type that is more likely for dense liquids. These behavior modalities are quite distinct and are more likely to be handled properly by feature detectors and classifiers when the density of the item in the oven is known.

The value produced by the classifier can take on numerous forms and can be utilized by the control system in various ways. The output of the classifier could be a numerical, Boolean, or string value. Generally, the output of the classifier will contain information as to the state of the item in the chamber. The output could also include information regarding an appropriate action for the controller to take given the current state of the item to avoid the item entering a splatter state. The output of the classifier could also contain information as to sub-items in the chamber such as the fact that certain sub-items in the chamber were in an imminent splatter state, or appropriate intervening actions to take at the sub-item level.

The value of the classifier can be a numerical value providing a probability on the scale of zero to one as to the probability that the item in the chamber is in an imminent splatter state. That value can be compared to a threshold to generate a prediction that the item is in an imminent splatter state. For example, the control system could determine if the numerical value exceeded 0.5 and output a Boolean value of true to indicate that the item was in an imminent splatter state. Alternatively, the intelligence required to generate the Boolean value could be embedded in the classifier such that the output of the classifier was the equivalent of a set determination as to whether or not the item was in an imminent splatter state.

The output of the classifier could contain information regarding an action to take by the controller. For example, the output of the classifier could be a specific command for the controller to execute that would avoid the item from entering the splatter state such as a power shut off command or an instruction to move the item 10 cm towards the back of the chamber. As another example, the output of the classifier could include information to allow the electronic oven to continue heating the item while avoiding the need to shut off the electronic oven. This approach would be beneficial in that shutting off power can be disruptive and might unnecessarily extend the overall cooking time. As such, the control system can be configured to reduce power to the chamber enough to continue cooking at a maximum heat while still avoiding the splatter state. For example, if the electronic oven included an inverter to modulate an amount of energy emitted by a microwave energy source from a first level to a second level, the controller could issue a command to make such an adjustment in response to an evaluation of the sensor data. As another example, the output of the classifier could utilize a low-fidelity duty-cycle control approach to reduce the number of rectified cycles that are allowed to work on charging up the capacitor in a microwave energy source such as a magnetron. Specifically, the power level of the microwave could be decreased by gating an AC input to a microwave energy source to reduce a number of AC cycles delivered to a rectifier. In a particular approach, gating could be used to effectively switch 30 Hz out of 50 Hz, to obtain a power level that is proportionally lower than full-power.

In all of these approaches described in the previous paragraph, the output of the classifier could also just indicate a desired level of decrease in the power produced by the microwave energy source or a binary value indicating whether the power should be decreased or not, and an alternative portion of the control system could issue the actual commands required by the approaches described above. For example, the classifier could be capable of issuing one of five commands indicating the urgency for which the power level should be decreased and an alternative portion of the control system could be configured to reduce the power with varying speeds and to varying levels based on that output, wherein a very urgent value would lead to an instantaneous full shut off while a less urgent value would lead to a slow reduction in the output of power by 10%.

Figure 5:
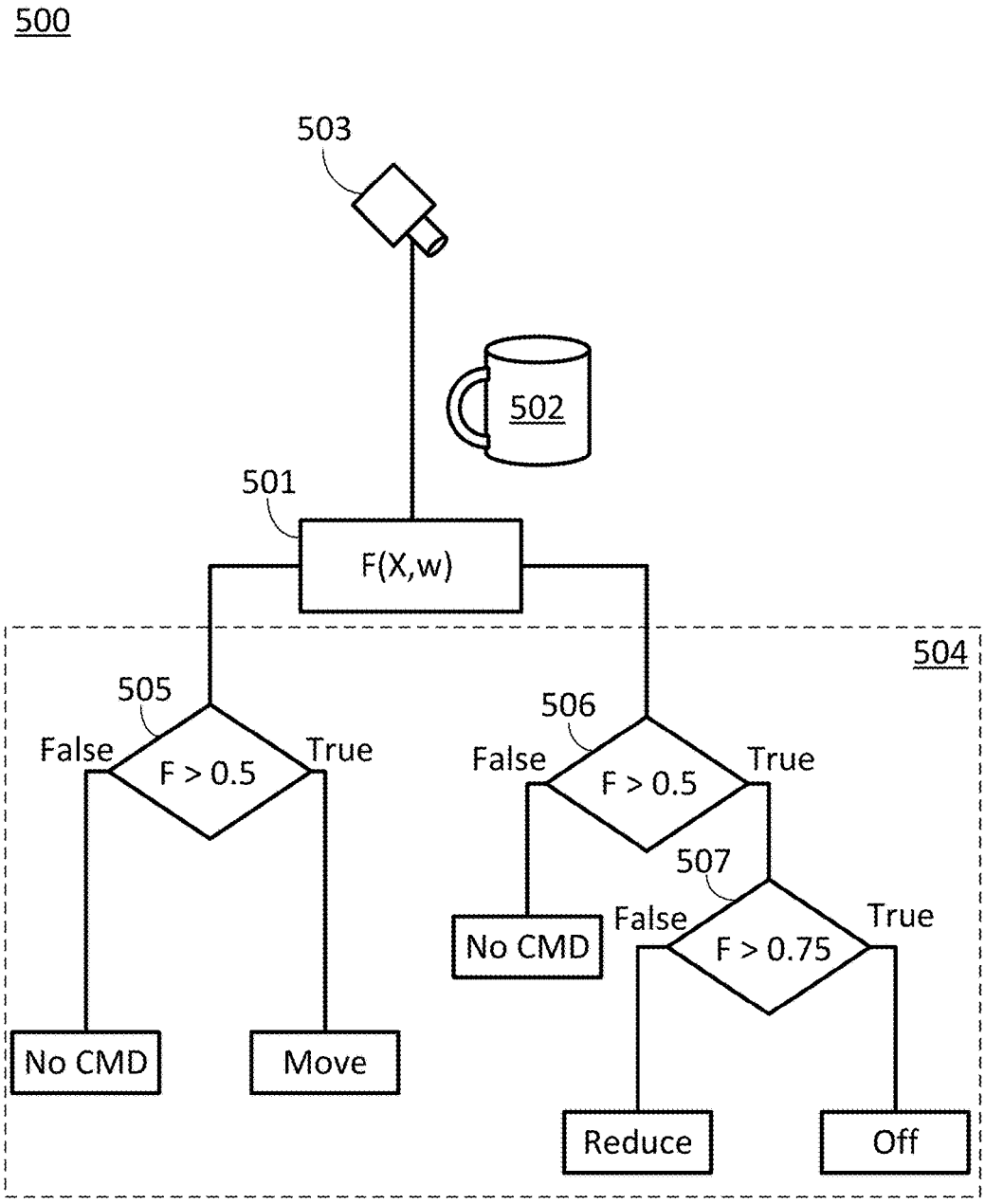
FIG. 5 illustrates a flow chart of a set of methods for producing a controller output to prevent splatter in an electronic oven that can be conducted by a controller in the electronic oven in accordance with embodiments disclosed herein.

The output of the classifier could be analyzed by a separate portion of the control system to derive similar commands to the ones described above. FIG. 5 illustrates a flow chart 500 in which classifier 501 produces a numerical value for the probability as to whether or not item 502 is in a splatter state based on sensor data from sensor 503. The output is then fed to a command generation system 504 that evaluates the probability and generates a responsive command. In the illustrated example, command generation system 504 can produce multiple commands. Evaluation 505 determines if a movement command should be generated while evaluations 506 and 507 determine if the power level in the chamber needs to be modified. In the illustrated case, the command generation system 504 does not produce any output if the probability is less than 0.5, will move the item and reduce heat if the probability is greater than 0.5 but less than 0.75, and will shut off the power entirely if the probability is greater than 0.75. Also, command generation system 504 can be initialized based on the identity of the item and other sensor data in the same way the classifier itself is initialized.

The output of the classifier could also include information that was specific to particular portions of the item. For example, the classifier could produce an output indicating that a sub-item in the chamber was about to splatter while a second sub-item was not. The command generation system could then take that output and redistribute the item and a pattern of electromagnetic energy in the chamber to apply more energy to the second sub-item and less to the first sub-item. Alternatively, and as described previously, the classifier itself could generate the commands directly with respect to preventing splatter states for specific items without the need for an intervening derivation of those commands by a command generation system.

The classifier can be trained with patterns of sensor data that have been tagged as being indicative of an imminent splatter state. The combined sensor data and tags can be referred to as training data. The electronic oven can be equipped to obtain additional training data. To obtain the training data, the system can record sensor data patterns, and attach an imminent splatter condition tag by detecting a splatter state and tagging the sensor data 1-2 seconds prior to the splatter. The electronic oven could be continuously storing the past 1-5 seconds of sensor data in a first-in-first-out buffer and immediately transfer the buffer to a more permanent memory location upon detection of a splatter state. The electronic oven could then transmit the sensor data to a central repository for storage. The electronic oven could also immediately utilize the training data to update its own classifier before transmitting the sensor data to a central storage location. The tags could also include information as to the specific location in which a splatter occurred. The training data could also include other data such as controller data if such data was used by the classifier.

Figure 6:
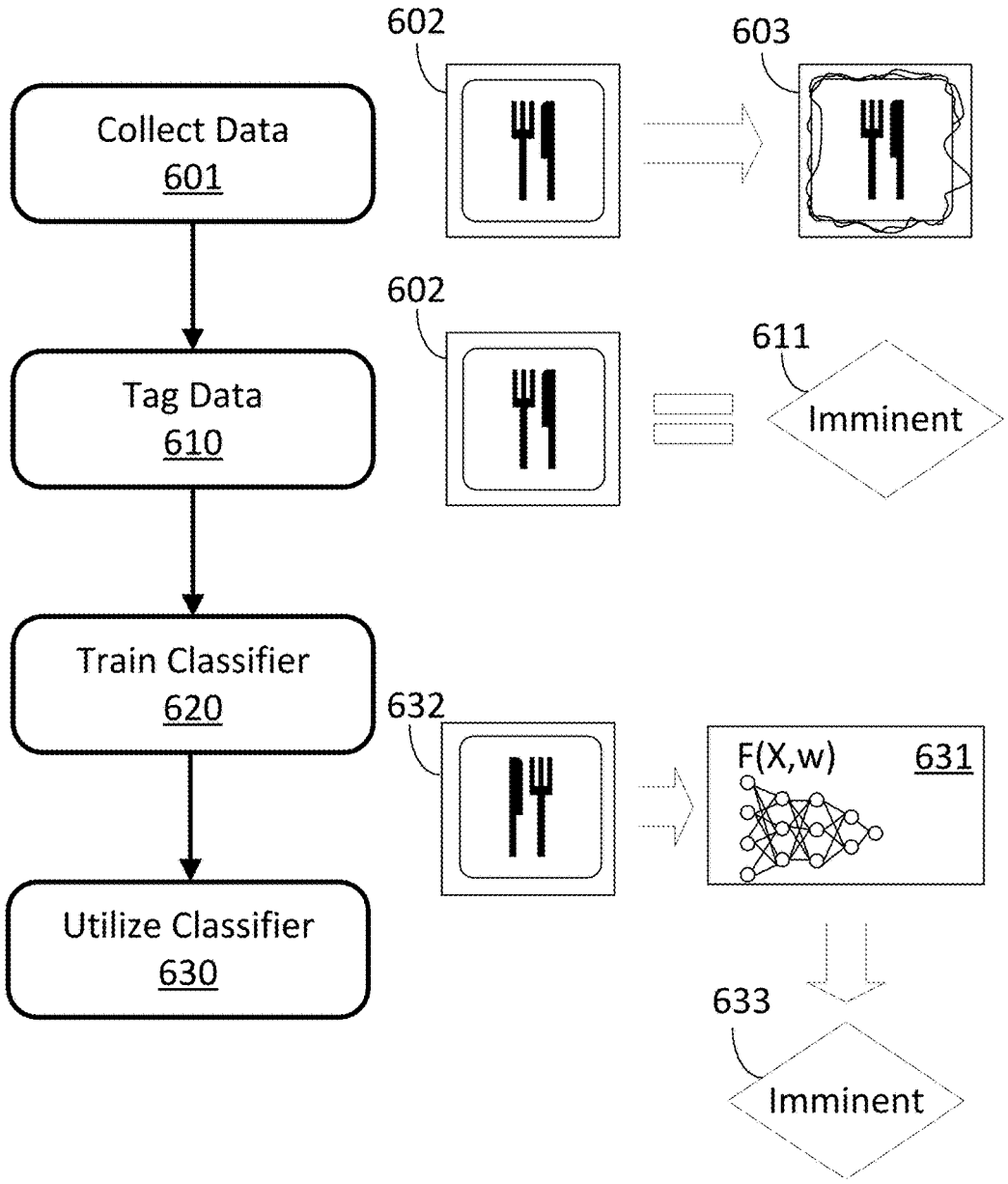
FIG. 6 illustrates a flow chart of a set of methods for training a classifier to prevent splatter in an electronic oven in accordance with embodiments disclosed herein.

FIG. 6 illustrates a flow chart 600 of a set of methods for obtaining and utilizing training data. In step 601, the data is collected. As illustrated this could include the electronic oven recording sensor data when the item was in state 602, and saving the data to memory when the item transfers to a splatter state 603. In step 610, the data for state 602 would be tagged to indicate that the state lead to an imminent splatter state 611. The combined sensor data for state 601 and tag 611 could then be stored as training data. In step 620, the training data could be used to train the classifier. The data could also be distributed on a network so that it could be used to train multiple classifiers. Furthermore, the classifier could be trained at a central location such as on a server and distributed to individual devices in the network periodically (such as at the end of each day) or upon request (such as when the electronic oven was used to heat a new item). In step 630, the trained classifier 631 would then be used to detect an imminent splatter state. Sensor data 632, which is similar but not identical to sensor data 602, would be detected by the sensors on an electronic oven. In response, classifier 631 would produce an output 633 indicating that the item in the chamber was likely in an imminent splatter state. The electronic oven could then take some type of intervening action to prevent the item from entering a splatter state.

While the specification has been described in detail with respect to specific embodiments of the invention, it will be appreciated that those skilled in the art, upon attaining an understanding of the foregoing, may readily conceive of alterations to, variations of, and equivalents to these embodiments. Any of the method steps discussed above can be conducted by a processor operating with a non-transitory computer-readable medium storing instructions for those method steps. The computer-readable medium may be memory within the electronic oven or a network accessible memory. Although examples in the disclosure included heating items through the application of electromagnetic energy, any other form of heating could be used in combination or in the alternative. The term "item" should not be limited to a single homogenous element and should be interpreted to include any collection of matter that is to be heated. These and other modifications and variations to the present invention may be practiced by those skilled in the art, without departing from the scope of the present invention, which is more particularly set forth in the appended claims.

What is claimed is:

1. An electronic oven, comprising:
- a chamber;
- a microwave energy source coupled to an injection port in the chamber;
- a visible light sensor;
- an infrared light sensor;
- a controller communicatively coupled to the visible light sensor, the infrared light sensor, and the microwave energy source; and
- a non-transitory computer-readable medium on the controller that stores instructions to:
  - generate a preprocessed sensor dataset, wherein the generation of the preprocessed sensor dataset comprises: combining sensor data from the visible light sensor and sensor data from the infrared light sensor;
  - evaluate, using the preprocessed sensor dataset, the combined sensor data from the visible light sensor and sensor data from the infrared light sensor;
  - generate a splatter prediction in response to the evaluation of the combined sensor data from the visible light sensor and sensor data from the infrared light sensor; and
  - decrease a power level of the microwave energy source in response to the splatter prediction.

2. The electronic oven of claim 1, wherein the instructions to evaluate the combined sensor data from the visible light sensor and sensor data from the infrared light sensor, using the preprocessed sensor dataset, include instructions to:
- identify an item in the chamber using the sensor data from the visible light sensor from the preprocessed sensor dataset;
- initialize a classifier based on an identity of the item as obtained during the identifying of the item; and
- apply the sensor data from the infrared light sensor from the preprocessed sensor dataset to the classifier.

3. The electronic oven of claim 2, wherein:
- an output of the classifier is a probability of a splatter event occurring in a proximate time period; and
- the splatter prediction is generated when the output of the classifier exceeds a threshold.

4. The electronic oven of claim 2, wherein:
- the classifier is a neural network; and
- the initializing of the classifier includes initializing a set of weights for the neural network based on the identity of the item.

5. The electronic oven of claim 1, wherein the instructions to evaluate the combined sensor data from the visible light sensor and sensor data from the infrared light sensor, using the preprocessed sensor dataset, include instructions to:
- identify an item in the chamber using the combined sensor data from the visible light sensor and sensor data from the infrared light sensor from the preprocessed sensor dataset;
- initialize a classifier based on an identity of the item as obtained during the identifying of the item; and
- apply the sensor data from the infrared light sensor from the preprocessed sensor dataset to the classifier.

6. The electronic oven of claim 1, wherein the instructions to evaluate the combined sensor data from the visible light sensor and sensor data from the infrared light sensor, using the preprocessed sensor dataset, include instructions to:
- apply the combined sensor data from the infrared light sensor and sensor data from the visible light sensor from the preprocessed sensor dataset to a classifier.

7. The electronic oven of claim 1, wherein the instructions to evaluate the combined sensor data from the visible light sensor and the sensor data from the infrared light sensor, using the preprocessed sensor dataset, include instructions to:
- segment an item in the chamber from a container for the item using at least the sensor data from the infrared light sensor from the preprocessed sensor dataset;
- blank a set of pixels in the sensor data from the infrared light sensor from the preprocessed sensor dataset based on the segmenting of the item in the chamber; and
- apply the sensor data from the infrared light sensor from the preprocessed sensor dataset, after blanking the set of pixels in the sensor data, to a classifier.

8. The electronic oven of claim 1, further comprising:
- an inverter to modulate an amount of energy emitted by the microwave energy source from a first level to a second level;
- wherein the instructions to evaluate the combined sensor data from the visible light sensor and sensor data from the infrared light sensor, using the preprocessed sensor dataset, include instructions to:
  - generate an array of the combined sensor data from the visible light sensor and sensor data from the infrared light sensor from the preprocessed sensor dataset;
  - provide the array to a classifier; and obtain an output of the classifier, wherein the output of the classifier is a probability of a splatter event occurring in a proximate time period; and wherein the instructions to decrease the power level of the microwave energy source in response to the splatter prediction include instructions to:

select the second level based on the output of the classifier.

9. The electronic oven of claim 1, wherein the instructions to decrease the power level of the microwave energy source in response to the splatter prediction include instructions to turn off the microwave energy source.

10. The electronic oven of claim 1, wherein the instructions to decrease the power level of the microwave energy source in response to the splatter prediction include instructions to gate an AC input to the microwave energy source to thereby reduce a number of AC cycles delivered to a rectifier.

11. A method for heating an item in a chamber of an electronic oven using a microwave energy source, wherein each step is executed by a controller in the electronic oven comprising:

generating a preprocessed sensor dataset, wherein the generation of the preprocessed sensor dataset comprises: combining sensor data from the visible light sensor and sensor data from the infrared light sensor;

evaluating, using the preprocessed sensor dataset, the combined sensor data from a visible light sensor and sensor data from an infrared light sensor, wherein the controller is communicatively coupled to the visible light sensor and the infrared light sensor;

generating a splatter prediction in response to the evaluation of the combined sensor data from the visible light sensor and sensor data from the infrared light sensor; and decreasing a power level of the microwave energy source in response to the splatter prediction, wherein the controller is also communicatively coupled to the microwave energy source.

12. The method of claim 11, wherein evaluating the combined sensor data from the visible light sensor and sensor data from the infrared light sensor, using the preprocessed sensor dataset, includes:

identifying an item in the chamber using the sensor data from the visible light sensor from the preprocessed sensor dataset;

initializing a classifier based on an identity of the item as obtained during the identifying of the item; and applying the sensor data from the infrared light sensor from the preprocessed sensor dataset to the classifier.

13. The method of claim 12, wherein:

an output of the classifier is a probability of a splatter event occurring in a proximate time period; and the splatter prediction is generated when the output of the classifier exceeds a threshold.

14. The method of claim 12, wherein:

the classifier is a neural network; and the initializing of the classifier includes initializing a set of weights for the neural network based on the identity of the item.

15. The method of claim 11, further comprising:

identifying an item in the chamber using the combined sensor data from the visible light sensor and sensor data from the infrared light sensor from the preprocessed sensor dataset;

initializing a classifier based on an identity of the item as obtained during the identifying of the item; and applying the sensor data from the infrared light sensor from the preprocessed sensor dataset to the classifier.

16. The method of claim 11, wherein the evaluating of the combined sensor data from the visible light sensor and sensor data from the infrared light sensor, using the preprocessed sensor dataset, includes:

applying the combined sensor data from the infrared light sensor and sensor data from the visible light sensor from the preprocessed sensor dataset to a classifier.

17. The method of claim 11, wherein the evaluating of the combined sensor data from the visible light sensor and sensor data from the infrared light sensor, using the preprocessed sensor dataset, includes:

segmenting an item in the chamber from a container for the item using at least the sensor data from the infrared light sensor from the preprocessed sensor dataset;

blanking a set of pixels in the sensor data from the infrared light sensor from the preprocessed sensor dataset based on the segmenting of the item in the chamber; and applying the sensor data from the infrared light sensor from the preprocessed sensor dataset, after blanking the set of pixels in the sensor data, to a classifier.

18. The method of claim 11, wherein:

evaluating the combined sensor data from the visible light sensor and sensor data from the infrared light sensor, using the preprocessed sensor dataset, includes:

generating an array of the combined sensor data from the visible light sensor and sensor data from the infrared light sensor from the preprocessed sensor dataset;

providing the array to a classifier; and obtaining an output of the classifier, wherein the output of the classifier is a probability of a splatter event occurring in a proximate time period; and decreasing the power level of the microwave energy source in response to the splatter prediction includes:

selecting a level for an amount of energy emitted by the microwave energy source, as modulated by an inverter, based on the output of the classifier.

19. The method of claim 11, wherein decreasing the power level of the microwave energy source in response to the splatter prediction include instructions to turn off the microwave energy source.

20. The method of claim 11, wherein decreasing the power level of the microwave energy source in response to the splatter prediction include instructions to gate an AC input to the microwave energy source to reduce a number of AC cycles delivered to a rectifier.

* * * * *